US009476659B2

(12) United States Patent
Hall

(10) Patent No.: US 9,476,659 B2
(45) Date of Patent: Oct. 25, 2016

(54) GAS FLOW SYSTEM FOR A LONG-BARREL FIREARM

(71) Applicant: F & D Defense LLC, Seminole, OK (US)

(72) Inventor: Corby Hall, New Braunfels, TX (US)

(73) Assignee: F & D Defense LLC, Seminole, OK (US)

( * ) Notice: Subject to any disclaimer, the term of this patent is extended or adjusted under 35 U.S.C. 154(b) by 0 days.

(21) Appl. No.: 14/077,626

(22) Filed: Nov. 12, 2013

(65) Prior Publication Data

US 2014/0305297 A1 Oct. 16, 2014

Related U.S. Application Data

(60) Provisional application No. 61/727,254, filed on Nov. 16, 2012.

(51) Int. Cl.
*F41A 5/18* (2006.01)
*F41A 5/26* (2006.01)

(52) U.S. Cl.
CPC ... *F41A 5/26* (2013.01); *F41A 5/18* (2013.01)

(58) Field of Classification Search
CPC ..... F41A 5/18; F41A 5/22; F41A 5/26; F41A 5/28; F41A 5/36
USPC ..... 89/191.01, 193, 191.02, 192
See application file for complete search history.

(56) References Cited

U.S. PATENT DOCUMENTS 3,990,347 A * 11/1976 Junker ..... 89/185
5,404,790 A * 4/1995 Averbukh ..... F41A 5/28 89/193
6,622,610 B2 * 9/2003 Adkins ..... 89/193

FOREIGN PATENT DOCUMENTS

DE 3501516 * 7/1986

* cited by examiner

*Primary Examiner* — Stephen M Johnson
(74) *Attorney, Agent, or Firm* — Hall Estill Attorneys at Law; Tyler J. Mantooth

(57) ABSTRACT

A gas cycling firearm comprising a barrel having a breech end, a muzzle end, an inner surface defining a bore having a bore axis, and an outer surface, wherein the muzzle end is spaced a length L from the breech end, the barrel further having a port providing a fluid path between the bore and the outer surface, the port having an axis that intersects the bore axis at a position P from the muzzle end, where P is less than or equal to ⅓ L; and a gas flowpath extending between the gas port and the piston system, the gas flowpath having a length G and a volume V, wherein G is greater than ⅓ L.

2 Claims, 4 Drawing Sheets

| REQUIRED GAS TUBE LENGTH | | | 223 Rem | 308 Win | 338 LM |
|---|---|---|---|---|---|
| $B_{odb}$ | Barrel OD average (in) | | 0.850 | 0.940 | 1.050 |
| $B_{idb}$ | Barrel Bore ID (in) | | 0.223 | 0.308 | 0.338 |
| $B_{idt}$ | Gas Tube ID (in) | | 0.090 | 0.118 | 0.118 |
| $V_b$ | Volume of Barrel Bore (cu in) | $(L-P)\pi(B_{idb}/2)^2$ | 0.410 | 1.005 | 1.569 |
| $V_t$ | Volume of Gas Tube (cu in) | $1, 1.5, 2, 3V_b$ | 0.41 | 1.01 | 1.57 |
| G | Gas Tube Length (in) | $V_t/(\pi(B_{idt}/2)^2)$ | 64.46 | 91.98 | 143.58 |
| BARREL TIP DISPLACEMENT | | | | | |
| P | Port Position (in) | Breach to Port | 3.5 | 3.5 | 3.5 |
| D | Port Diameter (in) | | 0.085 | 0.1 | 0.118 |
| L | Barrel Length (in) | Breach to Tip | 14 | 17 | 21 |
| S | Port Pressure (psi) | Gauge | 20000 | 20000 | 20000 |
| F | Force at Port (lbs) | $S\pi(D/2)^2$ | 113 | 157 | 219 |
| E | Modulus of Elasticity (psi) | $2.9\times10^7$ | 2.9E+07 | | |
| I | Moment of Inertia of Barrel | $\pi(B_{odb}^4-B_{idb}^4)/64$ | 0.0255 | 0.0379 | 0.0590 |
| $Z_t$ | Barrel Tip Displacement (in) | $(FP^2/6EI)(3L-P)$ | 0.0121 | 0.0139 | 0.0155 |

Fig. 3A

| 223 Rem | | 308 Win | | 338 LM | |
|---|---|---|---|---|---|
| P | $Z_t$ | P | $Z_t$ | P | $Z_t$ |
| 1 | 0.001 | 1 | 0.001 | 1 | 0.001 |
| 2 | 0.004 | 2 | 0.005 | 2 | 0.005 |
| 3 | 0.009 | 3 | 0.010 | 3 | 0.011 |
| 4 | 0.016 | 4 | 0.018 | 4 | 0.020 |
| 5 | 0.024 | 5 | 0.027 | 5 | 0.031 |
| 6 | 0.033 | 6 | 0.039 | 6 | 0.044 |
| 7 | 0.044 | 7 | 0.051 | 7 | 0.058 |
| 8 | 0.056 | 8 | 0.066 | 8 | 0.075 |
| 9 | 0.068 | 9 | 0.081 | 9 | 0.093 |
| 10 | 0.082 | 10 | 0.098 | 10 | 0.113 |
| | | 11 | 0.115 | 11 | 0.134 |
| | | 12 | 0.134 | 12 | 0.156 |
| | | 13 | 0.153 | 13 | 0.180 |
| | | | | 14 | 0.205 |
| | | | | 15 | 0.230 |
| | | | | 16 | 0.256 |
| | | | | 17 | 0.283 |

GAS FLOW SYSTEM FOR A LONG-BARREL FIREARM

CROSS-REFERENCES TO RELATED APPLICATIONS

This original nonprovisional application claims the benefit of and priority to U.S. provisional application Ser. No. 61/727,254, filed Nov. 16, 2012, and which is incorporated by reference herein.

STATEMENT REGARDING FEDERALLY SPONSORED RESEARCH OR DEVELOPMENT

Not applicable.

BACKGROUND

1. Field of the Invention

The present invention relates to long barrel firearms that use gas cycling systems.

2. Description of the Related Art

In long-rifle firearms that use gas cycling systems, a gas port is positioned between the muzzle and the chamber of the barrel. Expanding gas resulting from discharge of a cartridge through the barrel bore flows through the gas port, where it is directed by a gas flowpath to a piston system or direct impingement that ejects the spent cartridge and chambers a new cartridge.

With precision firearms, however, ejection/expulsion of the expanding gas through the gas port causes an opposing force that affects harmonics of the barrel. Because this downward force is distal from the center of mass of the weapon, the magnitude of the torque caused by the force is sufficient to cause a deflection of the muzzle that unpredictably affects accuracy of the projectile. Specifically, the barrel tip displacement $Z_t$ can be approximated as $$Z_t=(FP^2/6EI)(3L-P), \quad (1)$$

where F is the force at the gas port caused by the ejecting gas, P is the distance between the breech and the port, E is the modulus of elasticity ($2.9\times10^7$ psi) of common barrel steels, I is the moment of inertia of the barrel, and L is the barrel length along the barrel axis between the breech and the tip. The moment of inertia, I, may be approximated as $$I=\pi(B_{odb}^4-B_{idb}^4)/64, \quad (2)$$

where $B_{odb}$ is the barrel outer diameter average and $B_{idb}$ is the barrel bore diameter. The force F at the gas port may be calculated as $$F=S\pi(D/2)^2, \quad (3)$$

where S is the gas port pressure and D is the port diameter. The required gas flowpath length G may be approximated as $$G=V_t/\pi(B_{idt}/2)^2), \quad (4)$$

where $V_t$ is the volume of the gas flowpath and $B_{idt}$ is the gas tube inner diameter

BRIEF SUMMARY

One solution to reducing the effect of a downward force and undesirable harmonics caused by expanding gas is reducing the distance between the center of mass of the weapon and the gas port. Although the magnitude of the force will be the same, all else being equal, the magnitude of the torque will be less relative to traditional gas port placement because of the decreased distance between the center of mass of the firearm and the gas port. This decreased torque leads to decreased deflection of the muzzle, reduced harmonics influence, and therefore a more accurate projectile trajectory.

To address such problems, an embodiment of the invention comprises a barrel having a breech end, a muzzle end, a sidewall defining a bore having a bore axis, and an outer surface, wherein the muzzle end is spaced a length L from the breech end, the barrel further having a port providing a fluid path between the inner surface and the outer surface of the barrel, the port having an axis that intersects the barrel axis at a position P from the muzzle end, where P is less than or equal to ⅓ L; and a gas flowpath extending between the gas port and the piston system, the gas flowpath having a gas tube length G and a volume V, wherein G is greater than ⅓ L.

BRIEF DESCRIPTION OF THE DRAWINGS

FIG. 3A is a table that shows the equations and calculations for three common calibers of long-rifle firearms having a gas port positioned a distance P from the breech, where P is three-and-a-half inches.

DETAILED DESCRIPTION OF VARIOUS EMBODIMENTS

Figure 1:
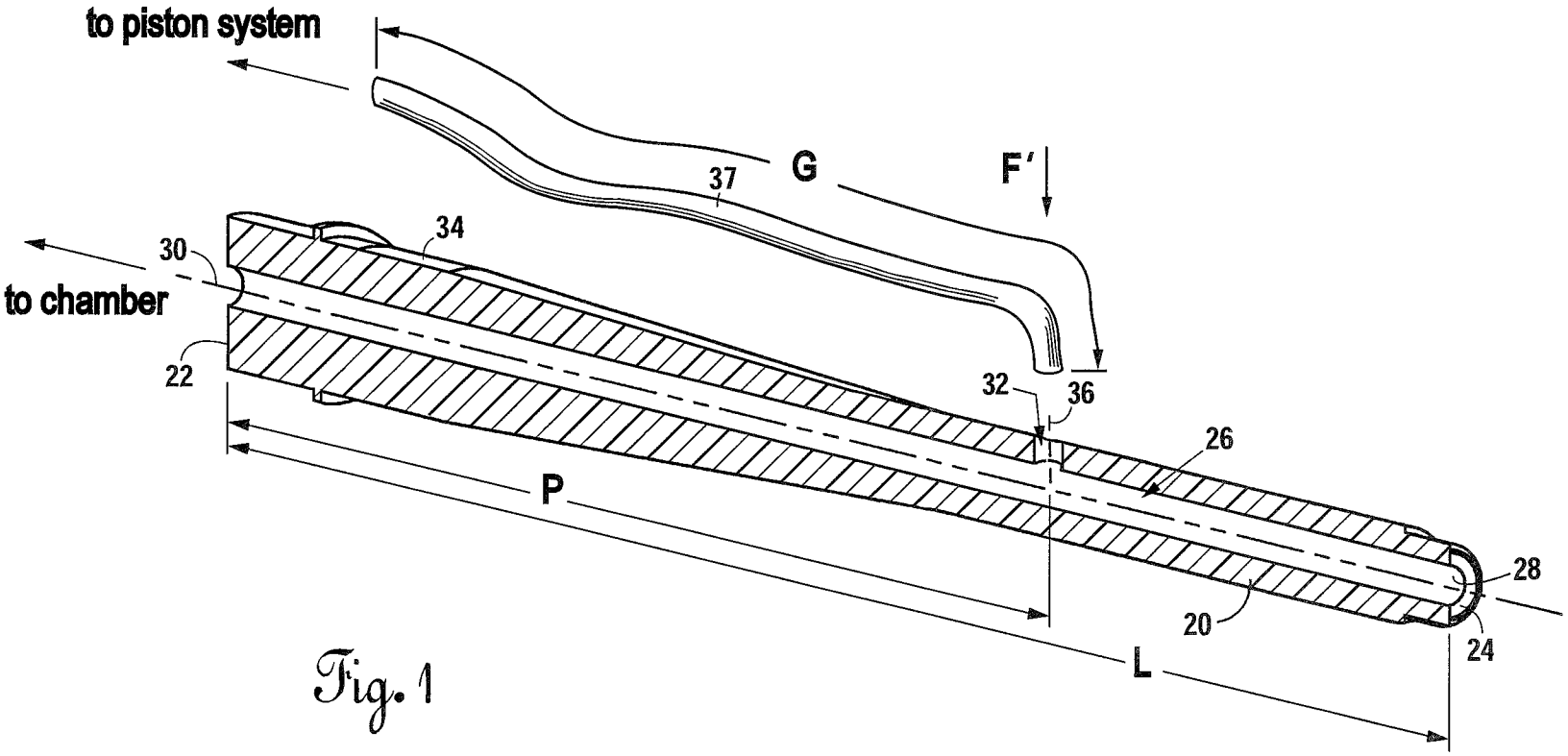
FIG. 1 is a sectional view along a midplane of a barrel of a long barrel, gas-cycling firearm having a gas port positioned closer to the muzzle end of the barrel than the breech end.

FIG. 1 shows a barrel 20 of a long barrel firearm with a direct impingement gas cycling system. The barrel 20 has a length L and is connected to a chamber (not shown) and has a breech end 22 and a muzzle end 24. The barrel further has a bore 26 defined by a cylindrical inner surface 28 and having a bore axis 30. A gas port 32 is disposed between an outer surface 34 and the inner surface 28. The gas port 32 is a generally cylindrical volume having a port axis 36 that perpendicularly intersects the bore axis 30 and a distance P from the breech end 22. The gas port 32 is closer to the muzzle end 24 than the breech end 22.

A gas tube 37 defining a flowpath of a length G and volume V is in fluid communication with the gas port 32. Expanding gases resulting from discharge of the firearm are redirected to the piston system through the gas tube 37 to eject the spent cartridge and chamber the next round. Gas expanding through the gas port 32 with force F results in a torque T=F×P, resulting in barrel tip displacement that is calculable according to equations (1)-(4) described supra.

Figure 2:
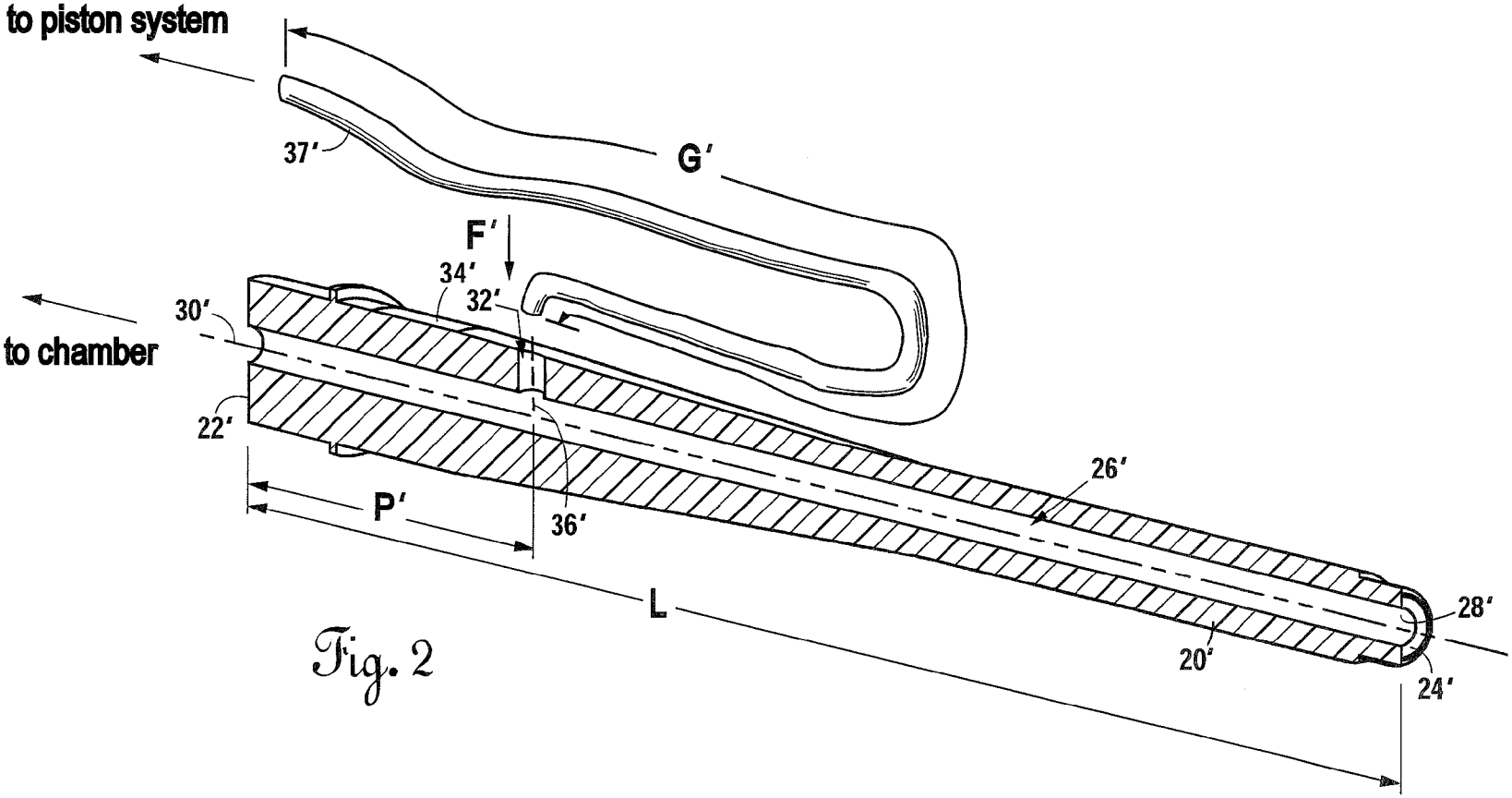
FIG. 2 shows an embodiment of the present invention.

FIG. 2 shows an embodiment of the invention. A barrel 20' has the same length L as barrel 20, a breech end 22', and a muzzle end 24'. A gas port 32' is positioned a length P' from the breech end 22. P' is less than or equal to one-third of the barrel length L. Gas expanding through the gas port 32 with force F—the same force described with reference to FIG. 1—results in a torque T'=F×P', which is less than T, and therefore results in less barrel tip deflection.

In piston and direct impingement cyclic systems, however, timing of the gas flow is critical to proper operation of the system, and the timing is partially dependent on the distance gas travels to the piston system, such as, referring to FIG. 1, the gas tube 37 defining a flowpath with a length G. The time for the gas pressure head to migrate from the chamber, through the bore 28', and to act on the piston system affects proper cycling of the firearm. If the pressure acts on the system too quickly or too slowly, the system may jam or otherwise fail.

Still referring to FIG. 2, by modifying an existing long-barrel firearm, such as that described with reference to FIG. 1, so that the gas port 32' is positioned as shown, the embodiment must compensate for the decreased time for the expanding gas to reach the gas port 36' as compared to the barrel 20 shown in FIG. 1. To address the problem of gas cycle timing, a gas tube 36' is connected to the gas port 36' having a length G', which is calculated according to equation (3) supra. All else being equal, the length G' of the gas flowpath defined by the gas tube 36' is longer than the length G of the flowpath defined by the gas tube 36. Although FIG. 2 shows a gas tube 37' of length G' extending from the gas port 36' to the chamber in a substantially straight path, an alternative embodiment of the invention contemplates the gas tube of length G' being coiled around the barrel 20' for compactness.

Figures 3B, 3C:
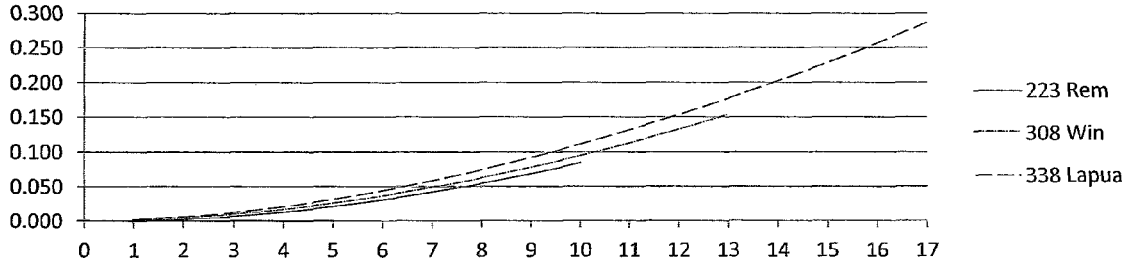
FIG. 3B shows specific calculations of barrel tip displacement when the gas port is placed at various positions along the barrel.
FIG. 3C is a graph of the calculations shown in FIG. 3B.

FIG. 3, which is collectively made up of FIGS. 3A-3C, are tables and graphs showing barrel tip displacement $Z_t$ for firearms of three common calibers of firearms. FIG. 3A shows the equations and details for calculating a specific gas tube length G and barrel tip displacement $Z_t$. FIG. 3B shows a specific barrel tip calculation $Z_t$ based on the characteristics shown in FIG. 3A for each of the calibers based on a port position P of three-and-a-half inches from the breech. FIG. 3C shows the non-linear increase in barrel displacement associated with position the port at various positions P between the breech and the barrel tip.

The present invention is described in terms of preferred and other specifically-described embodiments. Those skilled in the art will recognize that alternative embodiments of such device can be used in carrying out the present invention. Other aspects and advantages of the present invention may be obtained from a study of this disclosure and the drawings, along with the appended claims.

The invention claimed is:

1. A gas cycling firearm comprising:

a barrel having a breech end, a muzzle end, an inner surface defining a bore having a bore axis, and an outer surface, wherein the muzzle end is spaced a length L from the breech end, the barrel further having a port providing a fluid path between the bore and the outer surface, the port having an axis that intersects the bore axis at a position P from the muzzle end, where P is less than or equal to ⅓ L; and a gas flow path extending between the gas port and a piston system the gas flow path having a greater volume than the volume of the bore.

2. The gas cycling firearm of claim 1 wherein P is less than or equal to ¼ L.

* * * * *